US005792582A

United States Patent [19]

Yuh et al.

[11] Patent Number: 5,792,582

[45] Date of Patent: Aug. 11, 1998

[54] ELECTROPHOTOGRAPHIC IMAGING MEMBER RESISTANT TO CHARGE DEPLETION

[75] Inventors: Huoy-Jen Yuh, Pittsford; John S. Chambers, Rochester; John F. Yanus, Webster; Damodar M. Pai, Fairport, all of N.Y.

[73] Assignee: Xerox Corporation, Stamford, Conn.

[21] Appl. No.: 811,442

[22] Filed: Mar. 3, 1997

[51] Int. Cl.[6] ..... G03G 5/04

[52] U.S. Cl. ..... 430/59; 430/129

[58] Field of Search ..... 430/58, 59, 129

[56] References Cited

U.S. PATENT DOCUMENTS

| | | | |
|---|---|---|---|
| 4,265,990 | 5/1981 | Stolka et al. | 430/59 |
| 4,397,931 | 8/1983 | Limburg et al. | 430/59 |
| 4,504,564 | 3/1985 | Pai et al. | 430/132 |
| 4,539,282 | 9/1985 | Morimoto et al. | 430/59 |
| 4,563,408 | 1/1986 | Lin et al. | 430/59 |
| 4,599,286 | 7/1986 | Limburg et al. | 430/59 |
| 4,931,372 | 6/1990 | Takei et al. | 430/66 |
| 5,401,615 | 3/1995 | Pai et al. | 430/59 |
| 5,478,684 | 12/1995 | Nakamuta et al. | 430/58 |
| 5,492,785 | 2/1996 | Normandin et al. | 430/58 |
| 5,532,103 | 7/1996 | Markovic et al. | 430/131 |
| 5,670,284 | 9/1997 | Kishi et al. | 430/58 |

*Primary Examiner*—John Goodrow

[57] ABSTRACT

An electrophotographic imaging member including a supporting substrate, a charge generating layer comprising photoconductive pigment particles, a first film forming binder and 2,6-di-tert-butyl-4-methylphenol, and a charge transport layer. This imaging member may be formed by certain fabrication processes. The imaging member may be employed in an electrophotographic imaging process.

8 Claims, No Drawings

ELECTROPHOTOGRAPHIC IMAGING MEMBER RESISTANT TO CHARGE DEPLETION

BACKGROUND OF THE INVENTION

This invention relates in general to electrophotographic imaging members and more specifically, to an improved imaging member having improved electrical properties and processes for fabricating the electrophotographic imaging members.

In the art of electrophotography an electrophotographic plate comprising a photoconductive insulating layer on a conductive layer is imaged by first uniformly electrostatically charging the imaging surface of the photoconductive insulating layer. The plate or photoreceptor is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided toner particles on the surface of the photoconductive insulating layer. The resulting visible toner image can be transferred to a suitable receiving member such as paper. This imaging process may be repeated many times with reusable photoconductive insulating layers.

One common type of photoreceptor is a multilayered device that comprises a conductive layer, a charge generating layer, and a charge transport layer. The charge generating layer is located adjacent the conductive layer. The charge transport layer can contain an active aromatic diamine small molecule charge transport compound dissolved or molecularly dispersed in a film forming binder. This type of charge transport layer is described, for example in U.S. Pat. No. 4,265,990.

Ideally, a photoreceptor can be charged capacitively with no dark decay. Practically, this is difficult to achieve, especially for layered organic photoreceptor devices. These devices normally have dispersed photoconductive pigments as charge generation layers which contain thermally generated carriers and carriers produced during the erase step. These carriers, depending on their release times from charge traps or generating sites, cause charge depletion and dark decay. During the charging step, charge depletion results in voltage potentials that are less than the ideal capacitive value. Charge depletion is the difference between the capacitive value and the actual potential on a photoreceptor and is caused by free carriers and carriers released from shallow traps during the charging step.

Charge depletion has several consequences. A photoreceptor with charge depletion requires more corotron current to charge the photoreceptor to any given potential. Also if the minority carriers (electrons) are not transported out of the charge generator layer (which is the case with photoconductive pigments having a short electron range), the electric field is higher in the charge generator layer resulting in charge deficient spots that are visible in the final toner print image. The charge carriers causing depletion arise from many different sources. In photoreceptors utilizing benzimidazole perylene pigment particles in the charge generator layer, it has been discovered that one source of charge carriers which cause charge depletion is acid contamination or the use of anodized aluminum as the photoreceptor substrate. These charge depletion causing carriers in the benzimidazole perylene pigment containing charge generator layer are generated during the erase step and have a lifetime of seconds. This lifetime is much longer than the time between the erase and charge steps of most electrophotographic machines. Thus, the charge depletion causing carriers are still present in the charge generator layer during the charging step and charge deficient spots are formed.

Another problem is encountered in engineering printers utilizing benzimidazole perylene pigment particles in the charge generator layer and aromatic diamine in the transport layer of the photoreceptor. When this photoreceptor is exposed to positive scorotrons during toner image transfer to a receiving member such as paper, the regions of the photoreceptor not covered by paper experiences higher dark decay than the covered regions. This is due to the injection of positive charges from the charge transport layer surface into the photoreceptor which are then trapped in the charge generation layer for a lifetime of seconds. Some of these charges are swept out again during the subsequent negative scorotron charging step and some come out later as dark decay. Such an injection during the positive charging step is caused by charge transport layer surface oxidation caused by corona species. This higher dark decay is printed out as background in the printer when cut sheet paper or narrow paper is used. The problem worsens as print volume increases.

Thus, in imaging systems utilizing multilayered photoreceptors containing charge generating layers and charge transporting layers, adverse effects such as depletion and dark decay may be encountered during photoreceptor image cycling. This can reduce the practical value of multilayered photoreceptors that are cycled in automatic devices such as electrophotographic copiers, duplicators and printers.

INFORMATION DISCLOSURE STATEMENT

U.S. Pat. No. 4,599,286 to Limburg et al., issued Jul. 8, 1986—An electrophotographic imaging member is disclosed comprising a charge generation layer and a charge transport layer, the transport layer comprising an aromatic amine charge transport molecule in a continuous polymeric binder phase and a chemical stabilizer selected from the group consisting of certain nitrones, isobenzofurans, hydroxyaromatic compounds, hindered phenol structures and mixtures thereof. An electrophotographic imaging process using this member is also described.

U.S. Pat. No. 4,563,408 to Lin et al., issued Jan. 7, 1986—An electrophotographic imaging member is disclosed comprising a conductive layer, a charge transport layer comprising an aromatic amine charge transport or hydrazone molecule in a continuous polymeric binder phase, and a contiguous charge generation layer comprising a photoconductive material, a polymeric binder and a hydroxyaromatic antioxidant. An electrophotographic imaging process using this member is also described.

U.S. Pat. No. 4,931,372 to Takei et al., issued Jun. 5, 1990—An electrophotographic photoreceptor is disclosed, which is improved in layer coating property, mechanical strength and scratch and abrasion resistance, and also improved in electric property in repetitive use. The photoreceptor is comprised of a support having thereon a photoreceptive layer, and a surface portion of the layer, which is outermost from the support, contains a polycarbonate having at least one of principal repetition units represented by certain specified formulas, and a compound having a hindered phenol structural unit in the molecules thereof:

U.S. Pat. No. 5,401,615 to Pai et al., issued Mar. 28, 1995—An electrophotographic imaging member fabricated by forming on a charge generating layer a first coating including charge transporting molecules dispersed in an solution of a first polymer binder dissolved in a first solvent, drying the coating to remove the solvent to form a substantially dry charge transport layer, forming on the charge transport layer a second coating including charge transporting molecules and a chemical stabilizer additive selected from the group consisting of a nitrone, isobenzofuran, hydroxyaromatic compound and mixtures thereof molecularly dispersed in an electrically inactive second polymer binder in a solution of a second polymer binder dissolved in a second solvent, the first polymer binder being insoluble in the second solvent, and drying the second coating to remove the second solvent to form a substantially dry overcoat layer. This electrophotographic imaging member may be utilized in an electrophotographic imaging process.

U.S. Pat. No. 5,532,103 to Markovics et al., issued Jul. 2, 1996—An electrophotographic imaging member is described which includes a charge generating layer, a charge transport layer and an interphase region. The interphase region includes a mixture of a charge generating material and a charge transport material, in intimate contact, and may be formed, for example, by applying a charge transport material prior to drying or curing an underlying charge generating layer to produce an interphase structure that is different from the charge generating and charge transport layers.

U.S. Pat. No. 5,492,785 to Normandin et al. issued Feb. 20, 1996—An electrophotographic imaging member is disclosed having an imaging surface adapted to accept a negative electrical charge, the electrophotographic imaging member comprising a metal ground plane layer comprising at least 50 percent by weight zirconium, a siloxane hole blocking layer, an adhesive layer comprising a polyacrylate film forming resin, a charge generation layer comprising benzimidazole perylene particles dispersed in a film forming resin binder of poly(4,4'-diphenyl-1,1'-cyclohexane carbonate), and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

U.S. Pat. No. 4,504,564 to Pai et al., issued Mar. 12, 1985—An electrophotographic imaging member is produced by providing a photoconductive layer and depositing thereon a solution of polycarbonate and substituted N,N'-diphenyl-N,N'-bis(alkyl phenyl)-[1,1'-biphenyl]-4,4'diamine in a halogenated hydrocarbon solvent and a halogen-free organic solvent having a boiling point greater than the boiling point of the halogenated hydrocarbon solvent to provide a charge transport layer when solvents are removed.

U.S. Pat. No. 4,397,931 to Limburg et al., issued Aug. 9, 1983—This invention is generally directed to an organic layered photoresponsive device containing a charge transport layer comprised of a compound represented by a specific formula dispersed in a highly insulating and transparent organic resinous material and dispersed in said transport layer from about 0.1 weight percent to about 10 weight percent of an additive composition selected from the group consisting of a compound represented by specific formulae.

U.S. Pat. No. 4,539,282 to Morimoto et al., issued Sep. 3, 1985—Electrophotographic photosensitive element using zinc oxide in a photosensitive layer thereof formed in conductive support are described. Zinc oxide is used in combination with polycarbonate binder and a compound of the specific type. The compound is represented by a specific formula.

U.S. Pat. No. 4,265,990, issued to Stolka et al. on May 5, 1981—A photosensitive member is disclosed having photoconductive layer and a charge transport layer, the charge transport layer containing an aromatic diamine in an inactive film forming binder.

Thus, there is a continuing need for electrophotographic imaging members having improved electrical performance and resistance to degradation during image cycling.

SUMMARY OF THE INVENTION

It is, therefore, an object of the present invention to provide an improved imaging member and processes for fabricating an electrophotographic imaging member which overcomes the above-noted disadvantages.

It is another object of the present invention to provide an improved imaging member and processes for fabricating an electrophotographic imaging member which reduces charge depletion thereby avoiding the need for more corotron current to charge a photoreceptor to any given potential.

It is yet another object of the present invention to provide an improved imaging member and processes which reduces depletion and the associated charge deficient spots.

It is still another object of the present invention to provide an improved imaging member and processes for fabricating an electrophotographic imaging member which transports minority carriers (electrons) out of the generator thereby preventing charge deficient spot print out.

It is yet object of the present invention to provide an improved imaging member and processes for fabricating an electrophotographic imaging member that avoids background print out of regions on an imaging member between cut sheet paper or narrow receiving sheets that are exposed to positive corotrons during toner image transfer.

It is another object of the present invention to provide an improved imaging member and processes for fabricating an electrophotographic imaging member which resists dark decay.

It is still another object of the present invention to provide an improved imaging member and processes for fabricating an electrophotographic imaging member which reduces the injection of positive charges during charging of the fabricated imaging member with a transfer corotron.

It is yet object of the present invention to provide an improved imaging member and processes for fabricating an electrophotographic imaging member that is more stable during image cycling.

The foregoing objects and others are accomplished in accordance with this invention by providing an electrophotographic imaging member comprising a supporting substrate, a charge generating layer comprising
photoconductive pigment particles,
a first film forming binder and
2,6-di-tert-butyl-4-methylphenol, and a charge transport layer.

This imaging member may be formed by certain processes. The imaging member may be employed in an electrophotographic imaging process.

Electrostatographic imaging members are well known in the art. Electrostatographic imaging members may be prepared by various suitable techniques. Typically, a flexible or rigid substrate is provided having an electrically conductive surface. A charge generating layer is then applied to the electrically conductive surface. A charge blocking layer may be applied to the electrically conductive surface prior to the application of the charge generating layer. If desired, an adhesive layer may be utilized between the charge blocking layer and the charge generating layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate may be in the form of an endless flexible belt, a web, a rigid cylinder, a sheet and the like.

The thickness of the substrate layer depends on numerous factors, including strength desired and economical considerations. Thus, this layer for a flexible belt may be of substantial thickness, for example, about 125 micrometers, or of minimum thickness less than 50 micrometers, provided there are no adverse effects on the final electrostatographic device. The surface of the substrate layer is preferably cleaned prior to coating to promote greater adhesion of the deposited coating. Cleaning may be effected, for example, by exposing the surface of the substrate layer to plasma discharge, ion bombardment and the like.

If the substrate is electrically conductive, it need not be coated with an electrically conductive coating. If the substrate is electrically insulating, it is usually coated with an electrically conductive layer. The electrically conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g. a polyester web substrate such as Mylar available from E.I. duPont. de Nemours & Co. with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. A typical electrical conductivity for conductive layers for electrophotographic imaging members in slow speed copiers is about 102 to 103 ohms/square.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino) titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and have a thickness of between about 0.2 micrometer and about 5 micrometers.

An optional adhesive layer may applied to the hole blocking layer. Any suitable adhesive layer well known in the art may be utilized. Typical adhesive layer materials include, for example, polyesters, duPont 49,000 (available from E.I. duPont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Examples of typical photogenerating layers include organic photoconductive particles such as the X-form of metal free phthalocyanine described in U.S. Pat. No. 3,357,989, vanadyl phthalocyanine, copper phthalocyanine, dibromoanthanthrone, squarylium, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. The charge generating layer of the photoreceptor of this invention comprises a perylene pigment. The perylene pigment is preferably benzimidazole perylene which is also referred to as bis(benzimidazole). This pigment exists in the cis and trans forms. The cis form is also called bis-benzimidazo(2,1-a-1',1'-b) anthra (2,1,9-def:6,5,10-d'e'f') disoquinoline-6,11-dione. The trans form is also called bisbenzimidazo (2,1-a1',1'-b) anthra (2,1,9-def:6,5,10-d'e'f') disoquinoline-10,21-dione. Benzimidazole perylene is ground into fine particles having an average particle size of less than about 1 micrometer and dispersed in a suitable film forming binder. Optimum results are achieved with a pigment particle size between about 0.1 micrometer and about 0.3 micrometer. Benzimidazole perylene is described in U.S. Pat. No. 5,019,473 and U.S. Pat. No. 4,587,189, the entire disclosures thereof being incorporated herein by reference.

The dispersions for charge generating layer may be formed by any suitable technique using, for example, attritors, ball mills, Dynomills, paintshakers, homogenizers, microfluidizers, and the like.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-viylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

Any suitable solvent may be utilized to dissolve the binder. Typical solvents include tetrahydrofuran, toluene, methylene chloride, cyclohexanone, alkyl acetate and the like.

The photogenerating layer containing photoconductive pigment particles and the resinous binder material generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like.

Drying of the deposited coating may be effected by any suitable conventional technique such as oven drying, infra red radiation drying, air drying and the like. Drying is determined to be sufficient when the deposited film is no longer wet (not tacky to the hand).

The coating solution for the active charge transport layer of this invention comprises a solution of any suitable charge transporting small molecule, polycarbonate, 2,6-di-tert-butyl-4-methylphenol, and a solvent which swells or partially dissolves the film forming binder in the underlying charge generating layer. This active charge transport layer is capable of supporting the injection of photo-generated holes and electrons from the charge generating layer and allowing the transport of these holes or electrons through the organic layer to selectively discharge the surface charge. The charge transport layer in conjunction with the generation layer in the instant invention is a material which is an insulator to the extent that an electrostatic charge placed on the transport layer is not conducted in the absence of illumination. Thus, the active charge transport layer is a substantially non-photoconductive material which supports the injection of photogenerated holes from the generation layer. When this charge transport layer solution is applied to the charge generating layer in a first embodiment of this invention, the solvent for the charge transport layer swells or partially dissolves the charge generating layer, and a portion of the 2,6-di-tert-butyl-4-methylphenol in the solution diffuses into the charge generating layer so that upon completion of drying of the charge transport coating, both the charge generating layer and the charge transport layer contain 2,6-di-tert-butyl-4-methylphenol. In a second embodiment of this invention, the solvent for the charge transport coating solution need not swell or partially dissolve the charge generating layer because the 2,6-di-tert-butyl-4-methylphenol is added directly to the charge generating layer coating mixture prior to formation of the charge generating layer coating. Preferably, after drying of the charge transport coating in either of the aforesaid first and second embodiments, the charge generating layer contains between about 0.01 and about 2 percent by weight 2,6-di-tert-butyl-4-methylphenol, based on the total weight of the charge generating layer and the charge transport layer contains between about 0.03 and about 5 percent by weight 2,6-di-tert-butyl-4-methylphenol, based on the total weight of the charge transport layer. When the amount of 2,6-di-tert-butyl-4-methylphenol in the charge generating layer is less than about 0.01 percent by weight, the improvement in reducing charge depletion is not observed. When the amount of 2,6-di-tert-butyl-4-methylphenol in the charge generating layer exceeds about 2 percent by weight, the residual voltage after the erase step is increased and copy quality is degraded. When the amount of 2,6-di-tert-butyl-4-methylphenol in the charge transport layer is less than about 0.03 percent by weight, the improvement in reducing charge depletion is not observed. If the amount of 2,6-di-tert-butyl-4-methylphenol in the charge transport layer exceeds about 5 percent by weight, the photosensitivity is reduced to undesirable levels for satisfactory imaging. The level of 2,6-di-tert-butyl-4-methylphenol diffused into the charge generation level using the first embodiment depends on the specific coating process employed because the process can affect the amount of diffusion of the 2,6-di-tert-butyl-4-methylphenol into the charge generation layer. Further, the specific charge generation layer binder utilized and the solvents selected for coating the charge transport layer can also affect the amount of diffusion of the 2,6-di-tert-butyl-4-methylphenol into the charge generation layer when the second embodiment is utilized. For example, when the charge generation layer binder is partially soluble or swells in the charge transport layer solvent, the amount of 2,6-di-tert-butyl-4-methylphenol diffused into the charge generating layer is higher. Further, the specific coating method used to coat the charge transport layer can also affect the amount of diffusion of the 2,6-di-tert-butyl-4-methylphenol into the charge generating layer. The longer the generator layer remains in contact with the charge transport layer solution, the greater the amount of diffusion. Therefore, for example, dip coating of the charge transport layer allows more diffusion of the 2,6-di-tert-butyl-4-methylphenol into the charge generation layer than spray coating. Further, combinations of the above described first and second coating process embodiments may be utilized to achieve the desired final concentrations of 2,6-di-tert-butyl-4-methylphenol described above for the charge generating layer and the charge transport layer.

Any suitable charge transporting or electrically active small molecule may be employed in the charge transport layer of this invention. Typical charge transporting small molecules include, for example, pyrazolines such as 1-phenyl -3 (4'-diethylamino styryl)-5-(4"-diethylamino phenyl) pyrazoline, diamines such as N,N'-diphenyl-N,N'-bis(3)-methylphenyl)-(1,1'-biphenyl)-4,4'-diamine, hydrazones such as N-phenyl- N- methyl -3-(9-ethyl) carbazyl hydrazone and 4, diethyl amino benzaldehyde-1,2 diphenyl hydrazone and oxadiazoles such as 2,5-bis (4-N,N' diethylaminophenyl )-1,2,4-oxadiazole, triphenyl methanes such as Bis (4,N,N-diethylamino-2-methyl phenyl)-phenyl methane, stilbenes and the like. These electrically active small molecule charge transporting compounds should dissolve or molecularly disperse in electrically active charge transporting polymeric materials. The expression "charge transporting small molecule" as employed herein are defined as a monomeric chemical molecular species capable of supporting charge transport when dispersed in an electrically inactive organic resinous binder matrix. The expression "electrically active" when used to define the charge transport layer, the electrically active small molecule charge transporting compounds and the electrically active charge transporting polymeric materials means that the material is capable of supporting the injection of photogenerated holes from the generating material and capable of allowing the transport of these holes through the active transport layer in order to discharge a surface charge on the active layer. The expression "electrically inactive", when used to describe the electrically inactive organic resinous binder material which does not contain any electrically active moiety, means that the binder material is not capable of supporting the injection of photogenerated holes from the generating material and is not capable of allowing the transport of these holes through the material.

Still other examples of electrically active small molecule charge transporting compounds include aromatic amine compounds capable of supporting the injection of photogenerated holes and transporting the holes through the overcoating layer such as N,N'-diphenyl-N,N'-bis(alkylphenyl)-(1,1'-biphenyl)-4,4'-diamine wherein the alkyl is, for example, methyl, ethyl, propyl, n-butyl, and the like, N,N'-diphenyl-N,N'-bis(chlorophenyl)-[1,1'-biphenyl]-4,4'-diamine, N,N'-diphenyl-N,N'-bis(3-methylphenyl)-(1,1'-biphenyl)-4,4'-diamine, and the like. The specific aromatic diamine charge transport layer compound illustrated in the formula above is described in U.S. Pat. No. 4,265,990, the entire disclosure thereof being incorporated herein by reference.

Still other examples of aromatic diamine small molecule charge transport layer compounds include, for example, N,N,N',N'-tetraphenyl-[3,3'-dimethyl-1,1'-biphenyl]-4,4'-diamine; N,N'-diphenyl-N,N'-bis(2-methylphenyl)-[3,3'dimethyl-1,1'-biphenyl]-4,4'-diamine; N,N'-diphenyl-N,N'-bis(3-methylphenyl)-[3,3'-dimethyl-1,1'-biphenyl]-4,4'-diamine; N,N'-diphenyl-N,N'-bis(4-methylphenyl)-[3,3'dimethyl-1,1'-biphenyl]-4,4'-diamine; N,N,N',N'-tetra(2-methylphenyl)-[3,3'-dimethyl-1,1'-biphenyl]-4,4'-diamine; N,N'-bis(2-methylphenyl)-N,N'-bis(4-methylphenyl)-[3,3'-dimethyl-1,1'-biphenyl]- 4,4'-diamine; N,N'-bis(3-methylphenyl)-N,N'-bis(2-methylphenyl)-[3,3'-dimethyl-1,1'-biphenyl]-4,4'-diamine; N,N,N',N'-tetra(3-methylphenyl)-[3,3'-dimethyl-1,1'-biphenyl]-4,4'-diamine; N,N'-bis(3-methylphenyl)-N,N'-bis(4-methylphenyl)-[3,3'-dimethyl-1,1'-biphenyl]-4,4'-diamine; and N,N,N',N'-tetra(4-methylphenyl)-[3,3'-dimethyl-1,1'-biphenyl]-4,4'-diamine. The aromatic diamine small molecule charge transport layer compounds illustrated in the formula above are described in U.S. Pat. No. 4,299,897, the entire disclosure thereof being incorporated herein by reference.

Additional examples of small molecule charge transporting compounds include, for example, N,N,N',N'-Tetra-(4-methylphenyl)-[3,3'-dimethyl-1,1'-biphenyl]-4,4'-diamine' N,N'-bis(3-methylphenyl)-N,N'-bis(4-methylphenyl)-[3,3'-dimethyl-1,1'-biphenyl]-4,4'-diamine, and N,N'-bis(4-methylphenyl)-N,N'-bis(4-ethylphenyl)-[3,3'-dimethyl-1,1'-biphenyl]-4,4'- diamine. The second of these two specific small molecule aromatic diamine charge transport layer compounds is described in U.S. Pat. No. 4,299,897, the entire disclosure thereof being incorporated herein by reference. The substituents of aromatic diamine molecules should be free from electron withdrawing groups such as $NO_2$ groups, CN groups, and the like.

The charge layer of the photoreceptor of this invention should be capable of supporting the injection of photogenerated holes from the generation material and capable of allowing the transport of these holes through the active layer in order to discharge the surface charge on the active layer. The charge transport small molecule, polycarbonate film forming polymer and polymer and 2,6-di-tert-butyl-4-methylphenol should also be miscible in each other. The expression "miscible" is defined as a mixture which forms a solution or molecular dispersion of the small molecule transport compound and 2,6-di-tert-butyl-4-methylphenol in the film forming polycarbonate.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble. A dried charge transport layer containing between about 40 percent and about 50 percent by weight of the small molecule charge transport molecule based on the total weight of the dried charge transport layer is preferred.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

The hole transport layer preferably contains between about 25 to about 75 percent by weight of the small molecule hole transport compound, based on the total weight of the transport layer after drying.

Any suitable inactive resin binder soluble in chlorinated solvent or other suitable solvent may be employed in the process of this invention. Typical inactive resin binders soluble in these solvents include polycarbonate resih, polyvinylcarbazole, polyester, polyarylate, polyacrylate, polyether, polysulfone, and the like. Weight average molecular weights can vary from about 20,000 to about 1,500,000. The preferred electrically inactive resin materials are polycarbonate resins have a molecular weight from about 20,000 to about 120,000, more preferably from about 50,000 to about 100,000. Examples of the electrically inactive resin material include poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G., a polycarbonate resin having a molecular weight of from about 20,000 to about 50,000 available as Merlon from Mobay Chemical Company, and a polycarbonate resin available as PCZ 400 from Mitsubishi Chemical Co.

Any suitable solvent may be utilized to dissolve the polycarbonate film forming binder in the charge transport layer coating composition. The solvent should also swell or partially dissolve the film forming binder utilized in the charge generating layer. The expression "swell" as employed herein is defined as visibly expanding the generating layer in volume by at least about 10 percent of its original volume. The expression "partially dissolve" as employed herein is defined as dissolving between about 1 percent and about 10 percent of the film forming binder in the charge generating layer. Chlorinated solvents are an especially desirable component of the charge transport layer coating mixture for adequate dissolving of all the components in the charge transport layer, for its low boiling point and because they enable diffusion of 2,6-di-tert-butyl-4-methylphenol into the charge generating layer after application of the charge transport layer coating solution to the charge generating layer. Typical combinations of solvents and film forming binders where the solvent swells or partially dissolves the binder include, for example monochlorobenzene and polyvinylbutyral; tetrahydrofuran and polyvinylbutyral; toluene and PCZ; tetrahydrofuran and PCZ; methylene chloride and PCZ; monochlorobenzene and PCZ; 1,4 dioxane and polyvinylbutyral; and the like.

Due to the special relationship between the binder for the charge generating layer, the binder for the charge transport layer, the solvent for the charge transport layer, and the dissolved 2,6-di-tert-butyl-4-methylphenol in the charge transport layer coating composition, the final dried electrophotographic imaging member contains between about 0.01 percent and about 2 percent by weight 2,6-di-tert-butyl-4-methylphenol in the charge generating layer, based on the total weight of the charge generating layer and between about 0.03 percent and about 5 percent by weight 2,6-di-tert-butyl-4-methylphenol in the transport layer, based on the total weight of the charge transport layer. This photoreceptor exhibits dramatically increased resistance to charge depletion, improved transport of minority carriers (electrons) out of the generator layer, less dark decay, and reduced charge deficient spot print out. Generally, the charge transport layer coating solution contains between about 0.01 percent and about 5 percent 2,6-di-tert-butyl-4-methylphenol based on the combined weight of the small molecule charge transport compound and the binder.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1. In other words, the charge transport layer, is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

Other layers may also be used such as conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers.

The improved process for fabricating an electrophotographic imaging member containing the charge generator layer and charge transport layer combination of this invention leads to numerous advantages including, for example, providing an electrophotographic imaging member which exhibits reduced charge depletion thereby avoiding the need for more corotron current to charge a photoreceptor to any given potential. The electrophotographic imaging member of this invention also transports minority carriers (electrons) out of the generator thereby preventing charge deficient spot print out. Further, the photoreceptor of the present invention prevents background print out of regions on an imaging member between cut sheet paper or narrow receiving sheets that are exposed to positive corotrons during toner image transfer. Further the electrophotographic imaging member of this invention exhibits greater resistance to dark decay.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

ELECTRICAL SCANNING TEST

The electrical properties of the photoconductive imaging samples prepared according to Examples I, II, IIII and IV were evaluated with a xerographic testing scanner comprising a cylindrical photoreceptor drum having a diameter of 4 cm. When rotated, the drum produced a constant surface speed of 12.5 cm (30 inches) per second. A direct current pin corotron, exposure light, erase light, and four electrometer probes were mounted around the periphery of the photoreceptor samples. The sample charging time was 33 milliseconds. Both expose and erase lights were broad band white light (400–700 nm) outputs, each supplied by a 300 watt output Xenon arc lamp. A narrow band filter was used to ensure an exposure light wavelength of 670 nm. The relative locations of the probes and lights are indicated in the Table below:

TABLE

| Element | Angle (Degrees) | Position |
|---|---|---|
| Charge | 0 | 0 |
| Probe 1 | 26 | 9 |
| Expose | 45 | 15.7 |
| Probe 2 | 68 | 23.7 |
| Probe 3 | 133 | 46.4 |
| Erase | 288 | 100.5 |
| Probe 5 | 330 | 115.2 |

The test samples were first rested in the dark for at least 60 minutes to ensure achievement of equilibrium with the testing conditions at 35 percent relative humidity and 20° C. Each sample was then negatively charged in the dark to a development potential of about 700 volts. The charge acceptance of each sample and its residual potential after discharge by front erase exposure to 400 ergs/cm$^2$ were recorded. The test procedure was repeated to determine the photoinduced discharge characteristic (PIDC) of each sample by different light energies of up to 20 ergs/cm$^2$. The 10,000 cycle electrical testing results obtained for the test samples are described in the following Examples.

COMPARATIVE EXAMPLE I

A charge blocking layer is fabricated from an 8 percent by weight solution of polyamide in a butanol, methanol and water mixture. The butanol, methanol and water mixture percentages were 55, 36 and 9 percent, by weight, respectively. The charge blocking layer is dip coated onto an aluminum drum substrate and dried at a temperature of about 105° C. for about 5 minutes. The dried polyamide containing blocking layer has a thickness of about 1.5 micrometers. A charge generation coating mixture was prepared by dispersing 22 grams of benzimidazole perylene particles having an average particle size of about 0.4 micrometers into a solution of 10 grams polyvinyl butyral (B-79, available from Monsanto Chemical Co.) dissolved in 368 grams of n-butyl acetate solvent. This dispersion was milled in a Dynomill mill (KDL, available from GlenMill) with zirconium balls having a diameter of 0.4 millimeter for 4 hours. The average particle size of the benzimidazole perylene pigments in the dispersion after the milling is about 0.1 micrometers. The drum with the polyamide coating was dipped in the charge generation coating mixture and withdrawn at a rate of 20 centimeters per minute. The resulting coated drum was air dried to form a 0.5 micrometer thick charge generating layer. A charge transport layer coating solution was prepared containing 40 grams of N,N'-diphenyl-N,N'-bis(3-methylphenyl)-[1,1'-biphenyl]-4,4'-diamine and 60 grams of poly(4,4'-diphenyl-1,1'-cyclohexane carbonate) (PCZ 400 available from Mitsubishi Chemical Co.) dissolved in 400 grams of monochlorobenzene solvent. The charge transport coating solution was applied onto the coated drum by dipping the drum into the charge transport coating solution and withdrawn at a rate of 150 centimeters per second. The coated drum was dried at 110° C. for 20 minutes to form a 20 micrometer thick charge transport layer. The resulting photoreceptor drum was electrically cycled in a scanner in a controlled atmosphere of 35 percent relative humidity and 20° C. for 10,000 cycles. The scanner is described above. Depletion was observed to be 326 volts.

COMPARATIVE EXAMPLE II

The process described in Example I was repeated except that an anodized aluminum drum was employed instead of the drum coated with the polyamide. The resulting photoreceptor drum was electrically cycled in a scanner in a controlled atmosphere of 35 percent relative humidity and 20° C. for 10,000 cycles. The scanner is described above. Depletion was observed to be 520 volts.

EXAMPLE III

The process described in Example I was repeated except that 1 gram of 2,6-di-tert-butyl-4-methylphenol was dissolved in the charge transport layer coating composition. This amount of 2,6-di-tert-butyl-4-methylphenol was 1 percent by weight based on the total weight of the solids in the charge transport layer coating composition. After drying of the charge transport layer coating, the resulting photoreceptor drum was electrically cycled in a scanner under the same conditions as described in Example I. Depletion was observed to be 215 volts . This depletion was 30 percent lower than that obtained with the coated drum of Example I. Also, there was no detectable difference in sensitivity. Moreover, the photoreceptor was very stable.

EXAMPLE IV

The process described in Example II was repeated except that 3 grams of 2,6-di-tert-butyl-4-methylphenol was dissolved in the charge transport layer coating composition. This amount of 2,6-di-tert-butyl-4-methylphenol was 3 percent by weight based on the total weight of the solids in the charge transport layer coating composition. After drying of the charge transport layer coating, the resulting photoreceptor drum was electrically cycled in a scanner under the same conditions as described in Example II. Depletion was observed to be 368 volts. This depletion was also 30 percent lower than that obtained with the coated drum of Example II. Also, there was no detectable difference in sensitivity. Moreover, the photoreceptor was very stable.

EXAMPLE V

The process described in Example I was repeated except that the charge blocking layer and the charge generator layer. The charge blocking layer is fabricated from a 14.4 percent by weight solution of Zirconium butoxide and Y-amino propyl tri-methoxy silane in an isopropyl alcohol, butyl alcohol and water mixture. The isopropyl alcohol, butyl alcohol and water mixture percentages were 66, 33 and 1 percent. The Zirconium butoxide and Y-amino propyl tri-methoxy mixture percentages were 90 and 10 percent. The charge blocking layer is dip coated onto the aluminum drum substrate and dried at a temperature of 130° C. for 20 minutes. The dried Zirconium Silane film has a thickness of about 0.1 micrometers. 0.3 gram of 2,6-di-tert-butyl-4-methylphenol was dissolved in the charge generating layer coating composition, as described in the Example I, prior to application of the coating composition to the polyamide coating. This amount of 2,6-di-tert-butyl-4-methylphenol was 1 percent by weight based on the total weight of the solids in the charge transport layer coating composition. The resulting photoreceptor drum was electrically cycled in a scanner under the same conditions as described in Example II. The results of the scanner test is shown in the following table:

| | Photoreceptor of Example II Without Additive | Photoreceptor of Example V With Additive |
|---|---|---|
| Dielectric Thickness | 7.3 | 7.2 |
| $V_{depletion}$ (Volts) | 96 | 37 |
| Dark Decay (Volts) | 27 | 13 |
| $V_H$ (V) | 654 | 677 |
| dV/dX (V. cm²/erg) | 90 | 91 |
| $V_r$ (Volts) | 13 | 13 |

The symbols employed in the above table are defined as follows:

$V_{depletion}$ is the calculated voltage intercept on a QV charging curve.

Dark Decay is the voltage difference between the first and second probes.

$V_H$ is the voltage measured at the first probe.

dV/dX is is the initial slope of the PIDC curve.

$V_r$ is the voltage measured at the fourth probe.

The depletion observed with the photoreceptor of Example II was over 159 percent greater than the depletion observed with the photoreceptor containing the modified charge generating layer of this example (Example V). Also, there was substantially no difference in sensitivity.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising
a supporting substrate,
a charge generating layer comprising
benzimidazole perylene pigment particles photoconductive pigment particles,
a first film forming binder and
between about 0.01 and about 2 percent by weight 2,6-di-tert-butyl-4-methylphenol based on the total weight of said charge generating layer, and
a charge transport layer comprising
an aromatic diamine small molecule charge transporting molecule,
2,6-di-tert-butyl-4-methylphenol and
a polycarbonate film forming binder,
said charge generating layer being located between said substrate and said charge transport layer.

2. An electrophotographic imaging member according to claim 1 wherein said charge transporting layer comprises between about 0.03 and about 5 percent by weight of said 2,6-di-ter-butyl-4-methylphenol based on the total weight of said charge transporting layer.

3. An electrophotographic imaging member according to claim 1 wherein said polycarbonate film forming binder comprises poly(4,4'-diphenyl-1,1'-cyclohexane carbonate).

4. A processes for fabricating an electrophotographic imaging member comprising forming a charge generating layer comprising benzimidazole perylene photoconductive pigment particles dispersed in a first film forming binder, and forming on said charge generating layer a coating of a solution comprising
an aromatic diamine hole transporting small molecule,
2,6-di-tert-butyl-4-methylphenol,
a polycarbonate film forming binder which is different from said first film forming binder and
a solvent in which
said polycarbonate film forming binder is soluble,
said first binder is swellable or partially soluble and
said photoconductive pigment particles are substantially insoluble,
whereby said 2,6-di-ter-butyl-4-methylphenol diffuses from said coating into said charge generating layer, and drying said coating to form a charge transport layer overlying said charge generating layer wherein said charge generating layer comprises between about 0.01 and about 2 percent by weight 2,6-di-ter-butyl-4-methylphenol based on the total weight of said charge generating layer after said drying and said charge transporting layer comprises between about 0.03 and about 5 percent by weight 2,6-di-ter-butyl-4-methylphenol based on the total weight of said charge transporting layer after said drying.

5. A processes for fabricating an electrophotographic imaging member according to claim 4 wherein said polycarbonate film forming binder comprises poly(4,4'-diphenyl-1,1'-cyclohexane carbonate).

6. A processes for fabricating an electrophotographic imaging member comprising forming a charge generating layer comprising
benzimidazole perylene pigment particles photoconductive pigment particles dispersed in
a film forming binder and
between about 0.01 and about 2 percent by weight 2,6-di-tert-butyl-4-methylphenol, and forming on said charge generating layer a charge transport layer comprising
an aromatic diamine hole transporting small molecule and
a polycarbonate film forming binder.

7. A processes for fabricating an electrophotographic imaging member according to claim 6 wherein said charge transporting layer comprises between about 0.03 and about 5 percent by weight 2,6-di-ter-butyl-4-methylphenol based on the total weight of said charge transporting layer after drying.

8. A processes for fabricating an electrophotographic imaging member according to claim 6 wherein said polycarbonate film forming binder comprises poly(4,4'-diphenyl-1,1'-cyclohexane carbonate).

* * * * *